United States Patent [19]

Lynch et al.

[11] Patent Number: 4,462,168

[45] Date of Patent: Jul. 31, 1984

[54] VARIABLE ANGLE STRAIGHT EDGE

[75] Inventors: Thomas J. Lynch; John H. Pigman, both of Tempe, Ariz.

[73] Assignee: International Design Corporation, Phoenix, Ariz.

[21] Appl. No.: 508,246

[22] Filed: Jun. 27, 1983

[51] Int. Cl.[3] ..... B43L 7/00

[52] U.S. Cl. ..... 33/492; 33/1 N; 33/403

[58] Field of Search ..... 33/482, 403, 474, 1 F, 33/477, 174 B, 1 N, 492

[56] References Cited

U.S. PATENT DOCUMENTS

| | | | |
|---|---|---|---|
| 846,006 | 3/1907 | Bryson | 33/403 |
| 1,808,705 | 5/1928 | Owen, Jr. | 33/403 |
| 2,011,282 | 8/1935 | Hochman | 33/1 N |
| 2,042,031 | 5/1936 | Watson | 33/1 N |
| 2,364,529 | 12/1944 | Hill | 33/474 |
| 3,289,299 | 11/1964 | Elger | 33/403 |
| 3,378,931 | 4/1968 | Dolgorukov | 33/174 B |

*Primary Examiner*—Willis Little

*Attorney, Agent, or Firm*—LaValle D. Ptak

[57] ABSTRACT

A drafting tool functioning as a variable angle straight edge comprises an elongated rectangular main body portion made of transparent material. The lower edge of this main body portion has a first straight edge extending a major portion of the length of the main body portion from one end toward the other end to terminate at a point between the two ends. This edge is spaced a first distance from the top edge of the tool. A second straight edge parallel to the top edge and the first straight edge extends from the other end of the tool toward the termination point and is spaced a greater distance from the top edge than is the spacing between the top edge and the first straight edge. The two edges are interconnected by an offset forming a notch to receive the point of a drafting instrument at the junction of the offset and the first straight edge. This junction is made the point of origin of a protractor formed on the drafting tool, the base line of which on one side of the junction comprises the first straight edge and on the other side of the junction comprises a line spaced from the second straight edge.

7 Claims, 5 Drawing Figures

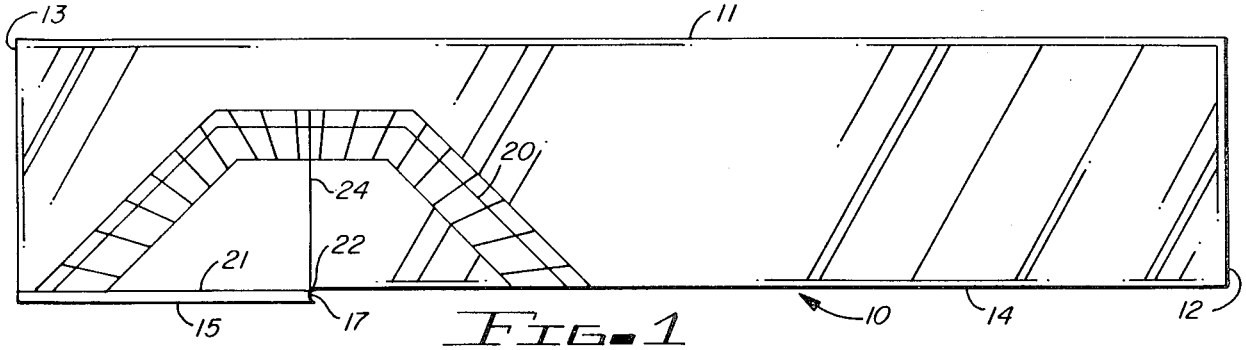
FIG. 1
FIG. 2
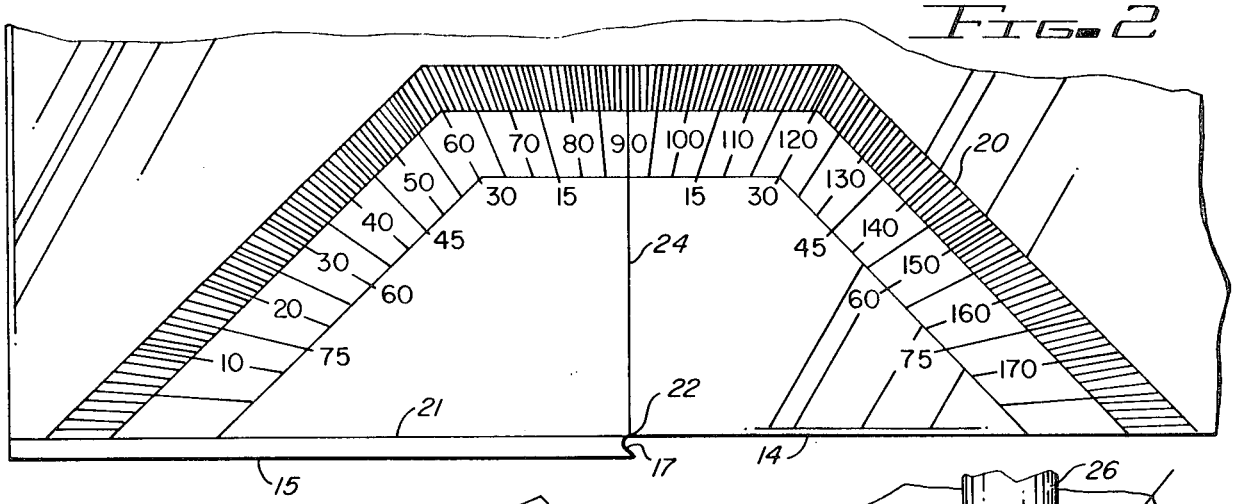
FIG. 3A
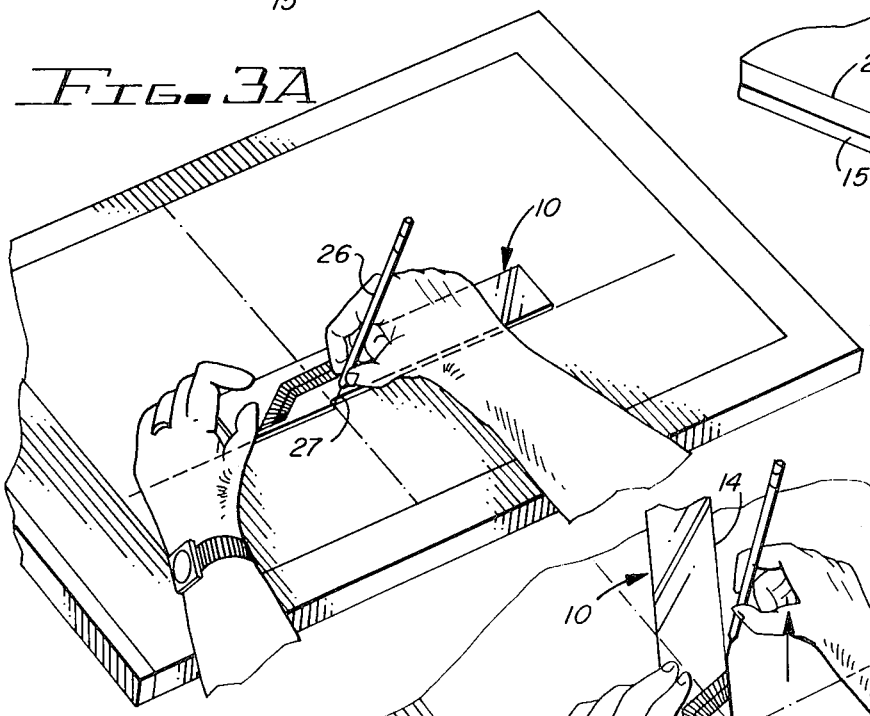
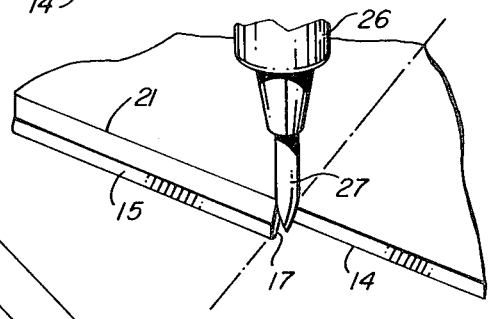
FIG. 3B
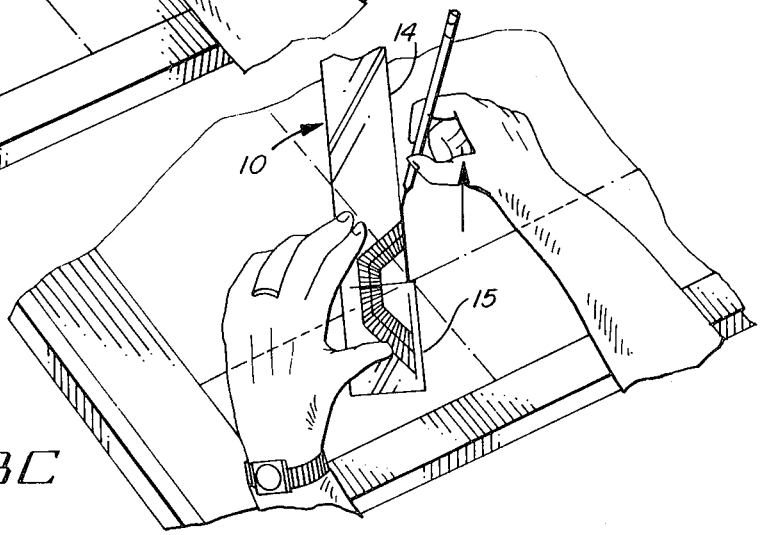
FIG. 3C

VARIABLE ANGLE STRAIGHT EDGE

BACKGROUND OF THE INVENTION

In the drafting of line drawings such as employed for parts layout, architectural renderings and the like, a variety of specialized tools commonly are employed. First of all, a drafting board or table with a straight edge or equivalent is generally used. Then, an assortment of drafting tools such as T-squares, rules, compasses, protractors, and various triangles of different angles are employed. When a draftsman uses such tools in laying out a drawing, much time is spent in picking up and setting down the various tools used at various times to draw lines at different angles, to draw circles, and the like. In addition, since these various drafting tools, particularly as used by professional draftsmen and architects, must be accurate, they are relatively expensive.

Even with the variety of conventional tools which are mentioned above, the ability to quickly and accurately perform many functions required of a draftsman often is not facilitated by the tools themselves, but the draftsman must make various mental calculations. This is particularly true in deciding which of various standard triangles are to be used for laying out angles for a given reference line or the like. For odd angles, a separate protractor usually is employed to establish points which then are connected together using a straight edge to form lines at the desired angles.

Basically, most drafting work for layout drawings comprises straight lines at various angles to one another. Thus, the common approach is to use T-squares (or their equivalents), triangles of various angles, and protractors. To replace all or some of these tools with a single multi-purpose tool has been attempted in the past.

The Elger U.S. Pat. No. 3,289,299 is directed to a protractor having a configuration in which the protractor itself is printed or etched onto the face of a trapezoidal-shaped base member. The top of the trapezoid is parallel to the bottom of the trapezoid which, in turn, serves as the base line for the protractor. The top and bottom are interconnected by converging oblique sides which make an angle of 60° with respect to the base line of the protractor. This is an angle which is commonly encountered in drafting so that the outside edges of the tool may be used directly to lay out lines at this angle. Also scribed on the face of the protractor are a large number of concentric circles each having a small hole on it to permit use of the tool to draw arcs or circles having the desired radii marked on the tool adjacent each of the concentric lines. The tool of this patent is capable of somewhat specialized use as a protractor but still requires conventional picking up and setting down of the tool to draw lines at various angles to one another from the point of origin of the protractor. The drafting tool of Elger further has a mounting block mechanism attached to it at the origin of the protractor to permit specialized use of the tool in drawing circles of various diameters. As a result, however, the origin point of the protractor is encircled with this additional apparatus so that it is not possible to directly strike a line from the origin point to some other point while this apparatus is in place.

Protractor tools which also may be used as straight edge rulers are disclosed in the patents to Bryson, U.S. Pat. No. 846,006, issued Mar. 5, 1907; and Owens, Jr., U.S. Pat. No. 1,808,705, issed June 2, 1931. The patent to Bryson discloses an elongated ruler having both longitudinal and perpendicular transverse spaced lines on it. In addition, a protractor with its origin near the center of one of sthe edges of the rule is provided and lines at various angles also are placed on the face of the ruler to facilitate its use as a layout drafting tool. The various lines on this tool permit it to be used to draw a variety of straight lines at various angles with respect to one another so that it greatly facilitates many layout operations. The tool, however, requires accurate placement or alignment of the origin of the protractor with a given point in order to strike lines at different angles from that point.

The Owen, Jr. patent is similar to the ruler of Bryson except that it has a rotatable eyelet mounted in it at the center point of circles which may be drawn by placing a pencil through a hole located at a measured distance from the eyelet. The tool itself is rectangular and has a protractor scribed on the face of the rule. The origin of the protractor is at the center point of one of the edges of the tool. Once again, however, accurate alignment of the origin of the protractor with a point on a line is required by a draftsman using the tool in order to strike a line from that point at some other angle.

It is desirable to provide a drafting tool for use in making a variety of layout drawings which overcomes the disadvantages of the various tools of the prior art. In addition, it is desirable to provide a variable angle straight edge which quickly and accurately coordinates the work of the draftsman in locating the origin of a protractor at a point on a line without the minute hand adjustments which normally are necessary in the use of conventional protractors and/or straight edges.

SUMMARY OF THE INVENTION

Accordingly, it is an object of this invention to provide an improved drafting tool.

It is another object of this invention to provide an improved drafting tool capable of performing multiple functions.

It is an additional object of this invention to provide a variable angle straight edge which is simple to use.

It is a further object of this invention to provide a multiple function drafting tool combining the functions of a straight edge and protractor which quickly and accurately aligns the tool with a point marked by the drafting instrument on a paper to permit drawing of lines at various angles with respect to one another rapidly, accurately, and easily.

In accordance with a preferred embodiment of the invention, a drafting tool is made of an elongated main body portion having two ends, with at least a first straight edge on it extending a portion of the length of the main body portion from one of the two ends toward the other end to a termination point. A second edge extends from the other end of the main body portion toward the first straight edge and terminates adjacent the first straight edge. An offset joins the termination points of the first and second edges to accomodate the drawing point of a drafting instrument at the juncture of the first straight edge and the offset.

BRIEF DESCRIPTION OF THE DRAWING

FIG. 1 illustrates a preferred embodiment of the invention;

FIG. 2 is an enlarged detail of a portion of the embodiment shown in FIG. 1;

FIG. 3A is an illustration of the manner of use of the embodiment shown in FIG. 1;

FIG. 3B is an enlarged detail illustrating a feature of the embodiment shown in FIG. 1; and FIG. 3C illustrates an additional feature of use of the embodiment shown in FIG. 1.

DETAILED DESCRIPTION

Referring now to the drawing, the same reference numbers are used throughout the different figures to designate the same or similar components. In FIG. 1, the drafting tool 10 in accordance with the preferred embodiment of the invention is shown in the form of an elongated rectangular transparent main body portion having a top edge 11, ends 12 and 13, and a first straight edge portion 14 extending from the end 12 toward the end 13 and terminating at a point 22. The edge 14 is parallel to the edge 11 and functions as a straight edge for drafting purposes.

To complete the tool shown in FIG. 1 and to facilitate its use as a variable angle straight edge, a second straight edge 15 extends from the end 13 toward the end 12 parallel to the top edge 11. The end 15 terminates at a point to the right of a vertical or perpendicular line through the terminal point 22 of the edge 14 as shown in FIG. 1. This termination point of the end of the edge 15 is interconnected with the point 22 forming the termination point of the edge 14 by means of an offset 17 (shown in greatest detail in FIGS. 2 and 3B).

As is apparent from an examination of the various figures of the drawing, the distance between the edge 14 and the top edge 11 is less than the distance between the edge 15 and the top edge 11. The edge 14 is tangent to the circle of the offset 17. Thus, the offset 17 which interconnects the termination points of the two straight edges 14 and 15 creates a notch which extends from the right-hand end of the edge 15 back toward the left (as viewed in FIGS. 1 and 2) to the point 22 at the end of the straight edge 14.

The point 22 is connected with the offset 17 by a small circular radius which is selected to be approximately equal to the radius of the point or tip of commonly used drafting instruments. Such a drafting instrument 26 is illustrated in all three portions of FIG. 3 and in greatest detail in FIG. 3B. The writing tip 27 also is shown in greatest detail in FIG. 3B. Such a tip commonly is a pencil point, but it may be the tip of an ink pen, also.

The tool shown in detail in FIGS. 1 and 2 has a protractor 20 printed, etched into, or scribed into one of the surfaces of the tool 10. The origin or zero point of the protractor is at the point 22 and a perpendicular or 90° line 24 extends from this point upwardly. The line 24 is perpendicular to the edge 11 and both of the straight edges 14 and 15 of the tool shown in FIG. 1. The base line 21, to the left of the point 22, is parallel to the edge 14, but is below the edge 14 by a distance equal to one-half the diameter of the point of commonly used drafting instruments. The details of the protractor are shown most clearly in FIG. 2 for an arrangement which has been found particularly useful to draftsmen. Other protractor layouts or arrangements, however, can be employed equally as well as the one shown in FIG. 2. The offsets of the edge 14 and line 21 and the radius of the offset 17 to the left of the point 22 permit direct use of the protractor portion of the tool without compensation for pencil point thickness.

The use of the tool as a variable angle straight edge is illustrated in FIGS. 3A, 3B, and 3C. To commence use of the tool, the surface of the medium on which the drawing is to be made is oriented in a manner to permit the drawing of a line (shown as a horizonal line in FIGS. 3A and 3C) in any conventional manner. If accurate orientation of this line with the border of the paper is not necessary, the straight edges 11 or 14 may be used to draw this line in accordance with the layout drawing which is being commenced. This horizontal line may be extended lightly across the entire sheet to facilitate use of the tool, if desired.

Generally, some other line at an angle to the first or horizontal line then extends from this first line to some other point. The tool is capable of striking any angle accurately from a given point on any line. To do this, the point 27 of the drafting instrument 26 is placed at the point from which this line at some angle is to commence. The tool then is moved to cause the circular notch at the point 22 to engage at the tip 27 of the pencil 26. Typically, this is done simply by sliding the edge 14 of the tool along the point 27 until the point 27 engages the notch 22. The angle to be struck then is determined by pivoting the tool 10 about the point 27 of the drafting instrument until the protractor 20 reads the correct angle by aligning the designated angle indicated on the protractor 20 with the line on the paper from which the new line is to extend. This is illustrated in FIG. 3C. When this has been accomplished, the drafting instrument 26 is moved along the straight edge 14 in the desired direction (upwardly as shown in FIG. 3C) to complete the new line at the proper angle extending from the first line. This sequence may be repeated continuously from point to point until the desired line drawing has been completed.

The manner in which the straight edges 14 and 15 cooperate with the base line and angle indicia on the protractor is most clear from an examination of FIG. 2. It may be seen in FIG. 2 that the base line of the protractor to the right of the origin at point 22 coincides with the straight edge 14. To the left of the origin 22, however, the base line 21 is scribed or printed on the tool and is parallel to and spaced a short distance from the straight edge 15.

Any time a pencil or drafting instrument point 27 is placed on a line on the paper or other medium on which the drawing is to be made, the protractor automatically is properly oriented whenever the tool is moved to snugly engage the point 27 of the drafting instrument with the notch at the origin 22. This notch is at the junction of the offset 17 and the terminal end or left end of the straight edge 14. It is a simple matter to spin the tool 10 while firmly engaging the offset 17 with the point 27 of the drafting instrument to align any of the desired angle indicia on the protractor 20 with the line on which the point 27 of the pencil 26 has been placed. Whenever the line corresponding to the desired angle overlies the line on which the pencil is placed, the straight edge 14 then extends at the desired angle from the original line, and drawing of the new line commences directly along the straight edge 14 from the point of origin 22 which was used to establish the angle in the first place.

Additional indicia can be provided along the straight edges 11, 14, or 15, or all of them in the form of measuring rules or rulers, if desired. This then would further facilitate use of the tool in accurately drawing line segments of pre-selected lengths. Such additional indicia have not been shown in the drawing, however, since they are not essential to an understanding of the basic features of the invention as shown in the illustrated embodiment.

Various changes and modifications will occur to those skilled in the art without departing from the true scope of the invention. Obviously, the relative lengths of the straight edges 14 and 15 may be varied without departing from the true scope of the invention. As illustrated, the tool is most adaptable for use by a right-handed draftsman. Reversal of the relative positions of the straight edges 14 and 15 and the offset 17 facilitates use of the tool by a left-handed person. This can be effected by simply turning the tool over on its other face and provisions can be made for marking the indicia on the protractor so that it may be read properly from either face. The alternative, of course, is to build different tools for use by right-handed and left-handed persons. Other changes and modifications will occur to those skilled in the art without departing from the true scope of the invention. The embodiment shown in the drawings and described above is to be considered as illustrative only of the features of the invention.

We claim:

1. A drafting tool including in combination:

an elongated main body portion having a top and having two ends with at least a first edge thereon spaced a first predetermined distance from the top and extending a portion of the length of said main body portion from one end thereof toward the other end thereof and terminating a second predetermined distance from said one end of said main body portion at a point intermediate the two ends of said main body portion;

a second edge extending from said other end of said main body portion toward said first straight edge and terminating adjacent the point of termination of said first straight edge at a third predetermined distance from the top of said main body portion which is greater than said first predetermined distance and terminating at a fourth predetermined distance from said one end adjacent the point of termination of said first straight edge; and wherein the end terminations of said first and second edges are interconnected with one another by an offset notch, which is spaced from the top of said main body portion at a distance between said first predetermined distance and said third predetermined distance to guide the drawing point of a drafting instrument into engagement with said first edge when such point is placed on a drafting surface and said drafting tool is urged against the point of the drafting instrument by a force parallel to said first straight edge in a direction from said other end of said main body portion toward said one end thereof, thereby permitting rotation of said drafting tool about such drafting instrument and also permitting the striking of a line by such drafting instrument directly from said offset notch along said first edge without necessitating the lifting of such drafting instrument from the drafting surface.

2. The combination according to claim 1 wherein a protractor is marked on said main body portion with the origin thereof at the junction of said offset and said termination point of said first straight edge, and the base line of said protractor from the origin extending toward said one end of said main body portion comprises said first straight edge and extending from the origin of said protractor toward the other end of said main body portion is a line spaced from said second edge.

3. The combination according to claim 2 wherein said main body portion is made of transparent material and said protractor markings include the portion of the base line thereof extending from the point of origin toward said other end and a line extending from the origin of said protractor perpendicular to said first straight edge toward the top edge of said main body portion.

4. The combination according to claim 3 wherein said offset notch is a segment of a circle having a radius substantially equal to the radius of the point of a drafting instrument to be used with said drafting tool and said first straight edge is tangent to said circle.

5. The combination according to claim 1 wherein said offset notch is a segment of a circle having a radius substantially equal to the radius of the point of a drafting instrument to be used with said drafting tool and said first straight edge is tangent to said circle.

6. The combination according to claim 5 wherein a protractor is marked on said main body portion with the origin thereof at the junction of said offset and said termination point of said first straight edge, and the base line of said protractor from the origin extending toward said one end of said main body portion comprises said first straight edge and extending from the origin of said protractor toward the other end of said main body portion is a line spaced from said second edge.

7. The combination according to claim 1 wherein said main body portion is substantially rectangular in shape with the top thereof being a straight top edge extending between the ends thereof; and said second edge is parallel to and spaced from said top edge by said third predetermined distance.

* * * * *